US006408927B2

(12) United States Patent
Kananen et al.

(10) Patent No.: US 6,408,927 B2
(45) **Date of Patent: *Jun. 25, 2002**

(54) DRAPERY RETAINER

(76) Inventors: Todd Kananen, 543 Hartsough; Bill Kananen, 701 Pacific, both of Plymouth, MI (US) 48170

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/294,763

(22) Filed: Apr. 19, 1999

Related U.S. Application Data

(60) Provisional application No. 60/082,274, filed on Apr. 18, 1998.

(51) Int. Cl.[7] ..... A47H 19/00
(52) U.S. Cl. ..... 160/349.2; 160/348; 160/330
(58) Field of Search ..... 160/19, 38, 330, 160/348, 349.1, 349.2

(56) References Cited

U.S. PATENT DOCUMENTS

| | | | | | |
|---|---|---|---|---|---|
| 1,291,015 | A | * | 1/1919 | Keller | 160/349.2 |
| 2,219,253 | A | * | 10/1940 | Cunningham | 160/349.2 |
| 2,260,194 | A | * | 10/1941 | Pidot | 160/349.2 |
| 2,329,446 | A | * | 9/1943 | Whitehead et al. | 160/349.2 |
| 2,431,934 | A | * | 12/1947 | Higgins | 160/349.2 |
| 3,735,795 | A | * | 5/1973 | Broek | 160/348 |
| 4,594,741 | A | * | 6/1986 | Payne | 160/349.2 |
| D287,988 | S | * | 1/1987 | Billinghurst | |
| 5,144,997 | A | * | 9/1992 | Marasco et al. | 160/349.2 |
| 5,184,661 | A | * | 2/1993 | Hannerstig | 160/349.2 |
| 5,343,925 | A | * | 9/1994 | Hannerstig | 160/349.2 |
| 5,517,722 | A | * | 5/1996 | Bender | 160/349.2 |

FOREIGN PATENT DOCUMENTS

| | | | | |
|---|---|---|---|---|
| GB | 2247827 | * | 3/1992 | 160/349.2 |

* cited by examiner

*Primary Examiner*—Blair M. Johnson
(74) *Attorney, Agent, or Firm*—James M. Deimen

(57) ABSTRACT

Drapery retainers generally comprising very large beads each pierced by a cylindrical hole through which a curtain or drape is drawn. The beads may be joined together to form multiple stacked beads or the beads may be equipped with attachment devices to fasten the beads to walls behind the drapes. The beads may be of any suitable base material such as wood, metal or plastic with the base material decoratively finished. Alternatively, the base material may be covered with decorative cloth or other wrap that can be replaced as desired. Also disclosed are devices for joining the beads together and for attaching cloth or wrap.

10 Claims, 17 Drawing Sheets

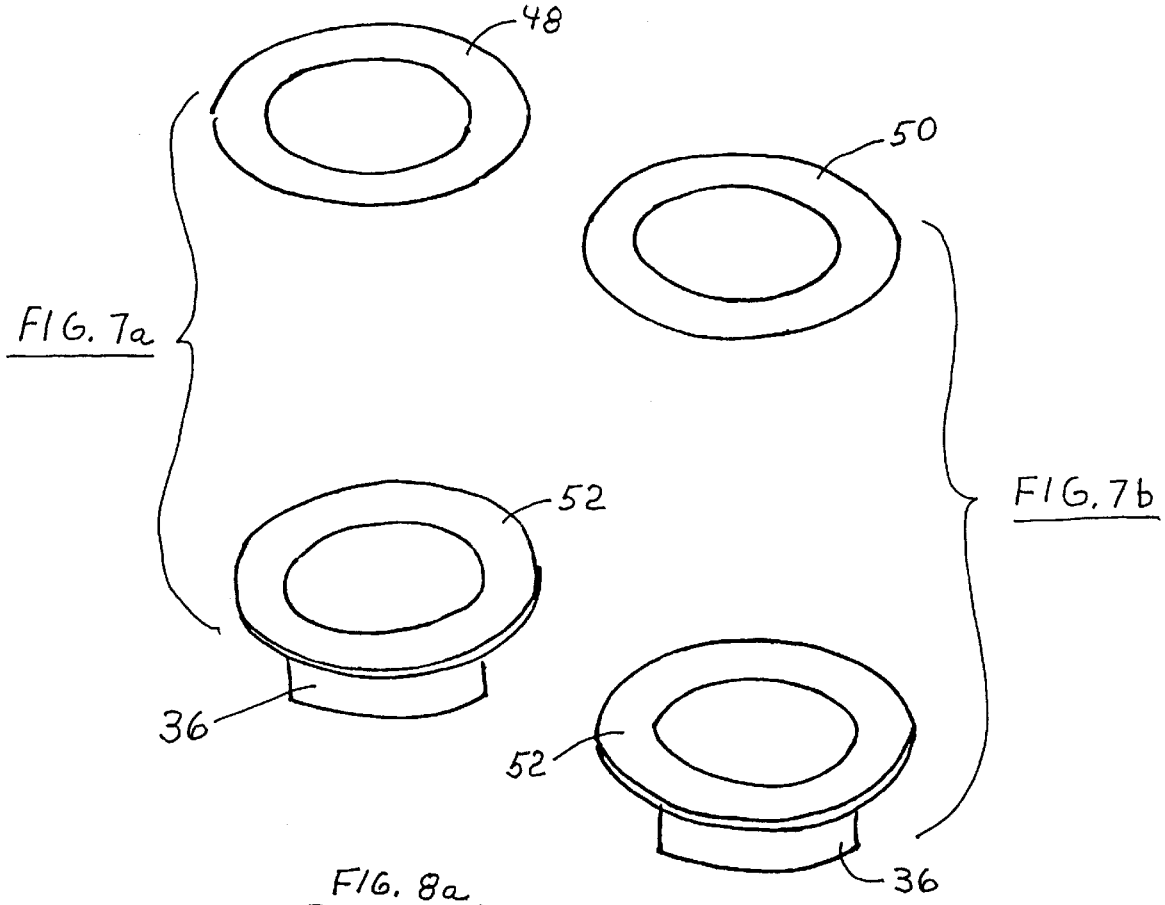
FIG. 8a
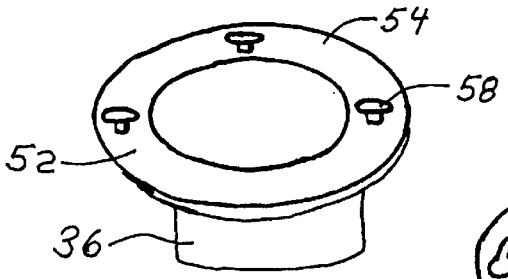
FIG. 8b
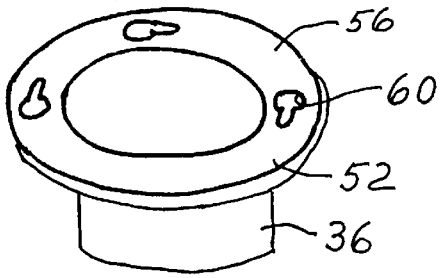

122
120
118
116
122
124
120

DRAPERY RETAINER

This application is based on Provisional Patent Application Ser. No. 60/082,274, filed Apr. 18, 1998.

BACKGROUND OF THE INVENTION

The field of the invention pertains to curtains and draperies and, in particular, to devices for stylishly retaining curtains and draperies in position when retracted.

Historically, curtains and drapes have been retracted on curtain rods from which they hang. When retracted the curtains form loose even vertical folds, accordion style. When extended the curtains partially or fully flatten. Often, the vertical folds remain straight without any attempt to tie back or otherwise ornament the curtains.

As an option various ornamental cords, strips of cloth and ornamental brackets and pins have been used to tie back the curtains or drapes in a pleasing and stylish manner.

With a view toward developing more useful and stylish devices to gather and tie back curtains and drapes, the following drapery retainers have been created.

SUMMARY OF THE INVENTION

The new drapery retainers generally comprise very large beads each pierced by a cylindrical hole through which a curtain or drape is drawn. The beads may be joined together to form multiple stacked beads or the beads may be equipped with attachment devices to fasten the beads to walls behind the drapes. The beads may be of any suitable base material such as wood, metal or plastic with the base material decoratively finished. Alternatively, the base material may be covered with decorative cloth or other wrap that can be replaced as desired. Also disclosed are devices for joining the beads together and for attaching cloth or wrap.

BRIEF DESCRIPTION OF THE DRAWINGS

FIGS. 7*a* and 7*b* illustrate alternative sleeves for joining stacked beads together;

FIGS. 8*a* and 8*b* illustrate another alternative for joining stacked beads together;

DESCRIPTION OF THE PREFERRED EMBODIMENTS

Figure 1:
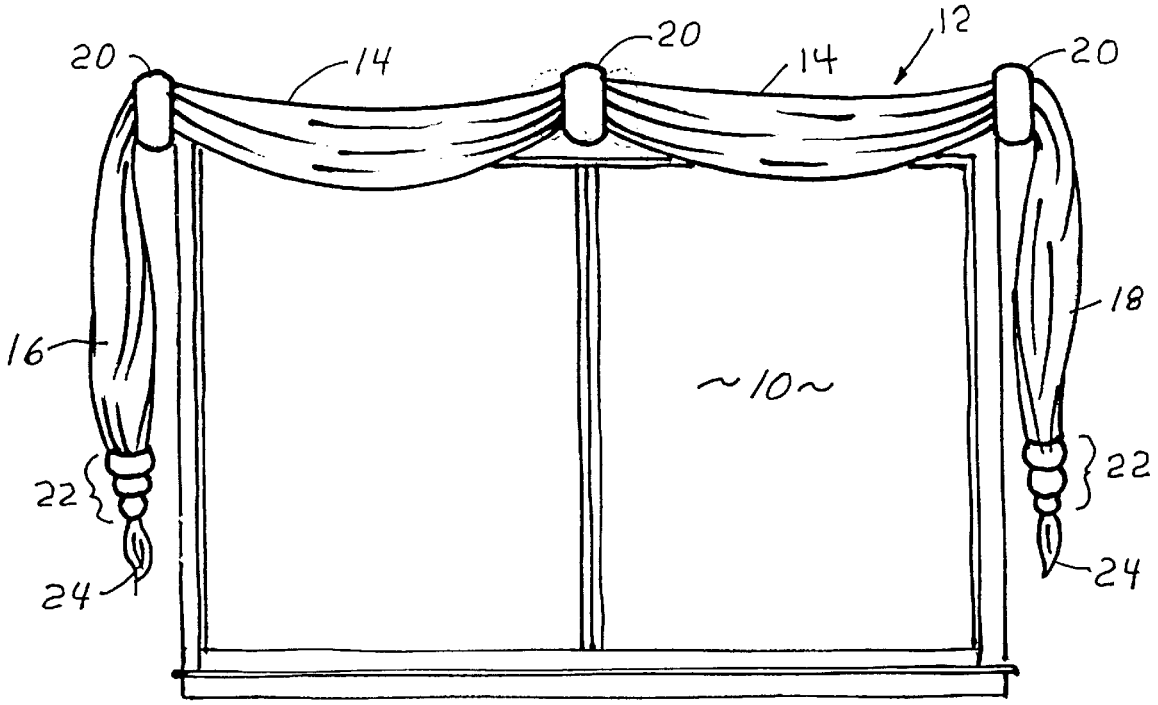
FIG. 1 illustrates a window and drapery with some of the new bead applications.

FIG. 1 illustrates a window 10 having a drape generally denoted by 12 positioned above the top of the window to form a valence 14. To each side 16 and 18 of the window the drape drops downward to partially frame the window. Above the window 10 supporting the drape 12 are three of the new retainer "beads" 20 through which the drape is gathered and passed as shown. On each side 16 and 18 of the window the drape 12 is gathered and passed through three stacked retainers 22 just above the tip ends 24 of the drape 12.

Figure 2:
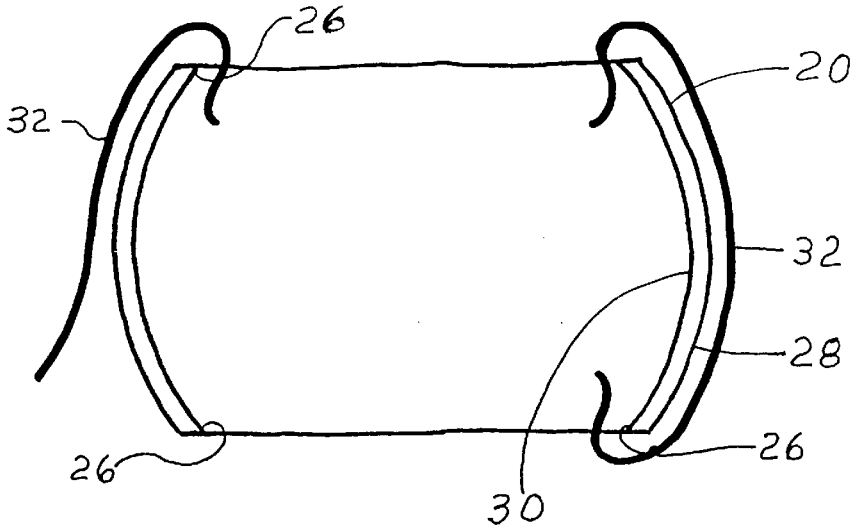
FIG. 2 is a cross-section of a bead and cloth cover.

In FIG. 2 a retainer "bead" 20 is shown having openings 26 formed by truncating a spherical hollow bead. The openings 26 are axially aligned to form a generally cylindrical opening through the retainer of sufficient size for a drape to pass through. The hollow bead interior may be either formed by a generally cylindrical hole through a solid bead or a fully hollow interior formed by a thin shell. The retainer may have adhesive applied to the outside surface 28 and a peripheral portion of the inside surface 30 adjacent the openings 26. A covering material 32 is then tightly applied to the surfaces 28 and 30. Thin smooth materials such as leather or vinyl may be applied in this manner for a tight look or more bulky materials that can retain their shape may also be applied to the retainer 20. Depending upon the adhesive and materials used, the covering material 32 may be removed and replaced as desired.

Figure 3:
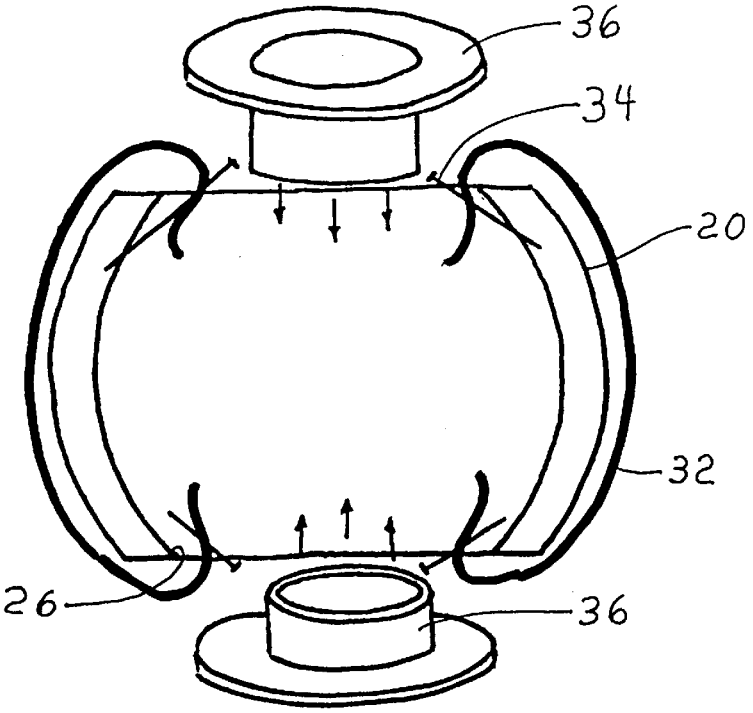
FIG. 3 is a cross-section of a bead, sleeves and loose cloth cover.

As an alternative the retainer 20 shown in FIG. 3 permits the covering material 32 to be fastened with pins 34 inside the openings 26. Retainers 20 made of soft or porous materials such as foam plastic are suitable for pinning the covering material 32. The covering material 32 may be gathered or pleated with the pinning used to retain the gathering or pleating as desired.

After the covering is completely pinned sleeves 36 are inserted into both openings 26 to cover the heads of the pins 34 and allow the drapery material to be drawn through the retainer 20 without snagging on the pins. The sleeves 36 are sized to tightly fit over the covering material 32 and pins 34.

Figure 4A:
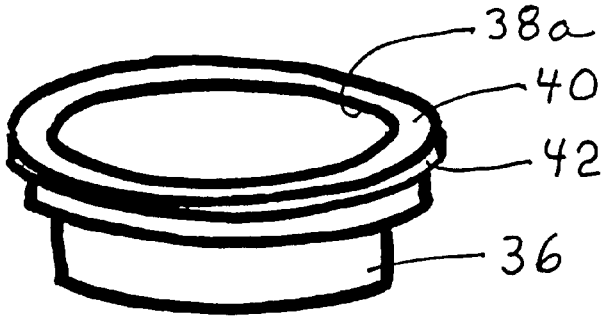
FIGS. 4*a,* 4*b* and 4*c* illustrate sleeves of differing diameters.
Figure 4B:
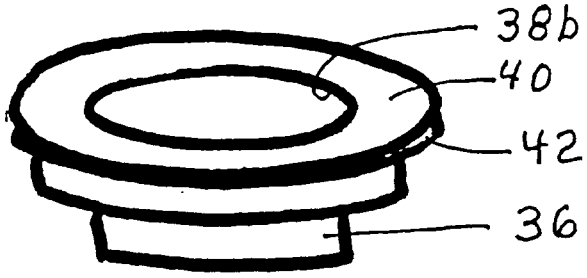
Figure 4C:
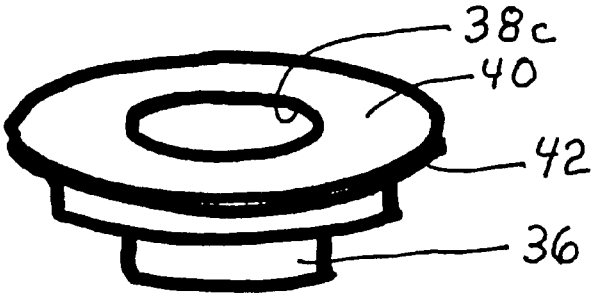

As shown in FIGS. 4*a,* 4*b* and 4*c* the sleeves 36 may be provided with a variety of diametral openings 38*a,* 38*b* and 38*c* for different drapery fabrics and drapery sizes. Thus, the sleeves 36 may be interchangeable and selectable to fit the drapery selected. The sleeves 36 may also be decorative elements by providing the exposed surfaces 40 and 42 with chrome, brass, bright color or carved design finishes for example.

Figure 5:
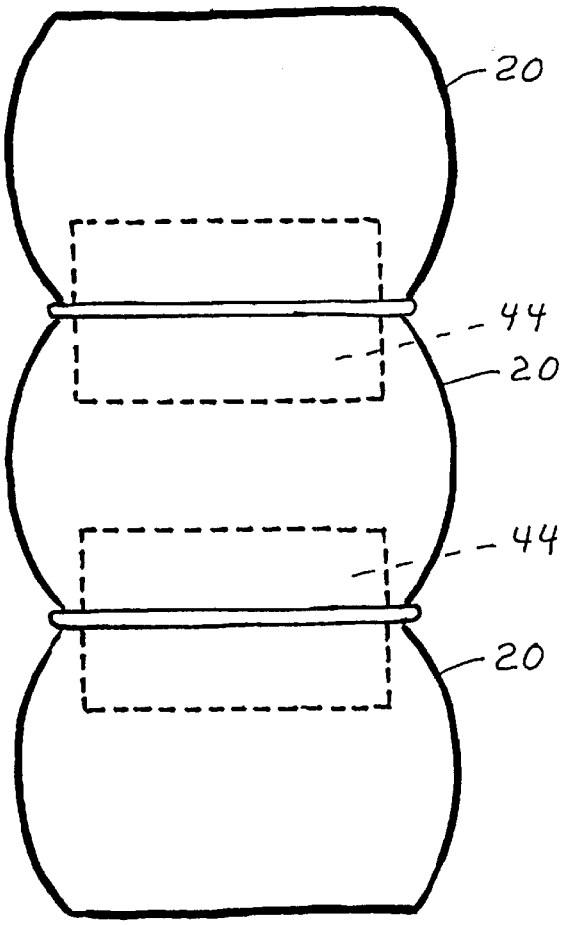
FIG. 5 illustrates stacked beads.

A plurality of retainers 20 can be grouped together as shown at 22 in FIG. 1. The retainers 20 may be of different diameters as shown at 22 or the same diameter as shown in FIG. 5. The friction of the drapery material drawn through the retainers 20 may be sufficient to keep each retainer in position or, as shown in FIG. 5, pressure fit sleeves 44 may be used to hold a plurality of retainers 20 together.

Figure 6A:
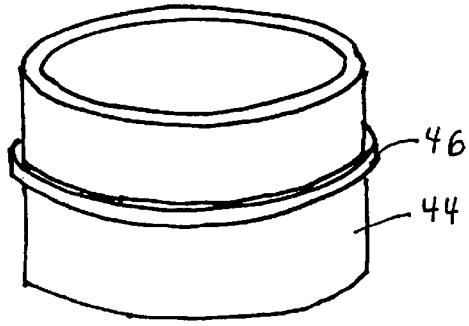
FIGS. 6*a* and 6*b* illustrate sleeves for joining stacked beads together.
Figure 6B:
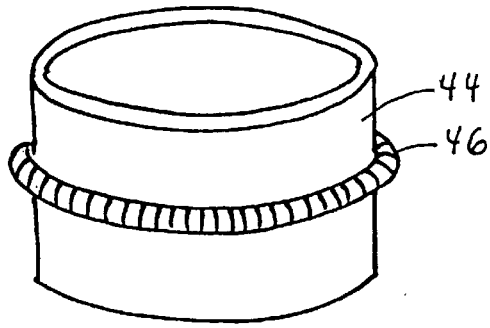

A rib 46 surrounding the sleeve 44 may be provided as a part of the sleeve and as illustrated in FIGS. 6*a* and 6*b* the ribs 46 may be plain as in FIG. 6*a* or decorative as in FIG. 6*b*. The rib 46 may be an integral part of the sleeve 44 or an elastic band stretched about the sleeve 44.

In FIG. 7 a pair of sleeves 36 are shown with an adhesive backed hook ring 48 to be attached in FIG. 7*a* to one sleeve and a complementary adhesive backed loop ring 50 to be attached to the other sleeve in FIG. 7*b*. After the adhesive backed hook ring 48 and loop ring 50 are adhesively attached to the top surfaces 52 of the respective sleeves 36 the sleeves may be inserted in a pair of retainers 20 and the retainers attached together by the hook ring 48 and loop ring 50 to form a two retainer stack. The hook ring 48 and loop ring 50 may be of Velcro® or similar materials.

As an alternative rings 54 and 56 having complementary pegs 58 and keyhole slots 60 as shown in FIGS. 8*a* and 8*b* may be made integral with the top surfaces 52 of the sleeves 36. In this embodiment after inserting the sleeves in a pair of retainers 20, the retainers may be joined by inserting the pegs 58 into the slots 60 and twisting to lock in place.

Figure 9:
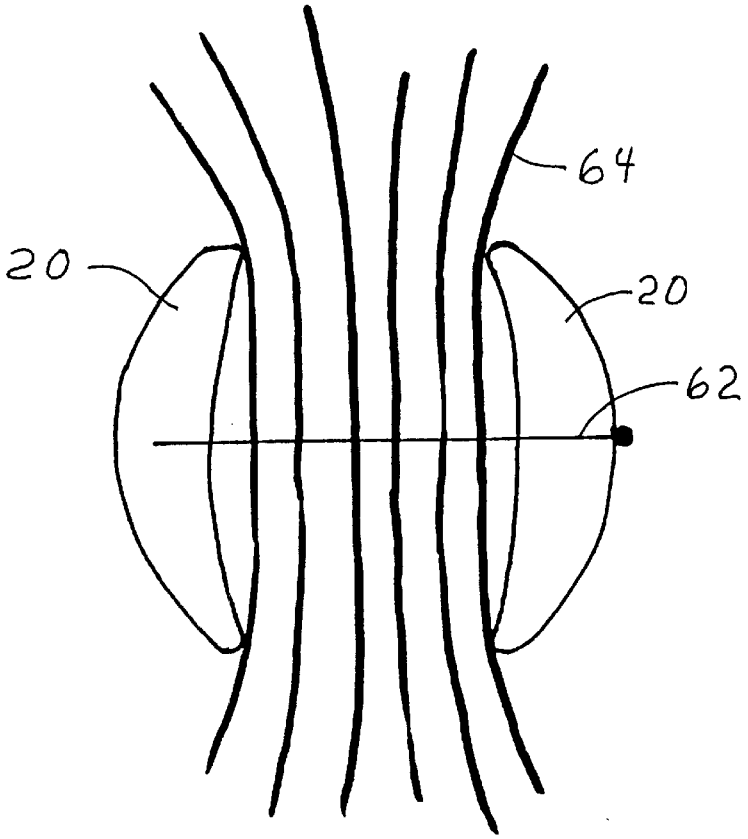
FIG. 9 is a cross-section of a bead showing a pin for retaining the bead.
Figure 10:
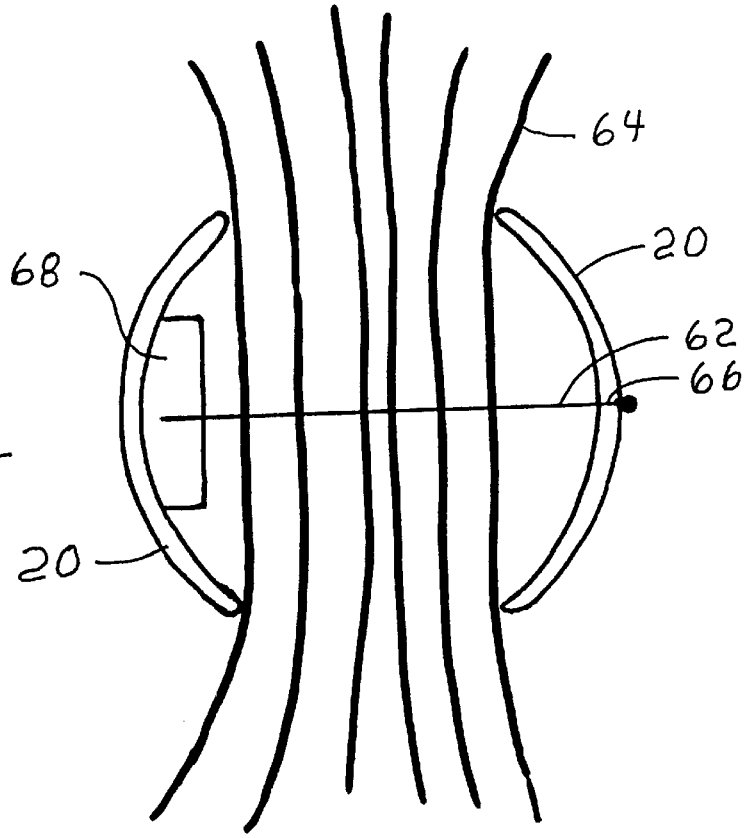
FIG. 10 is a cross-section of a bead showing an alternative pin and bead assembly for retaining the bead.

On drapery materials that tend to be bulky when gathered, the gathering and insertion into and through a retainer 20 will create sufficient resistance to movement that the retainer will stay in position on the drape. However, where this cannot be assured because of occasional rapid air movement or curious children, the retainer 20 may be pinned in place as shown in FIGS. 9 and 10. In FIG. 9 the retainer 20 is made of high density foam and a long pin 62 similar to a hair pin is inserted through the drape 64 from one side of the retainer into the other side. In FIG. 10 the retainer 20 is constructed of a hard plastic such as styrene and relatively thin. The pin 62 is passed through a predrilled hole at 66 and through the drape 64 to attachment in a foam block 68 inside the retainer 20. The foam block 68 is glued to the inside wall of the retainer 20.

Figure 11A:
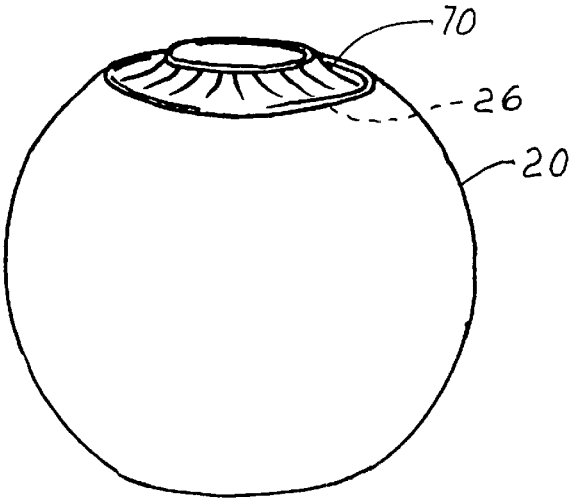
FIGS. 11*a* and 11*b* illustrate a bead with a retaining device in the hole.
Figure 11B:
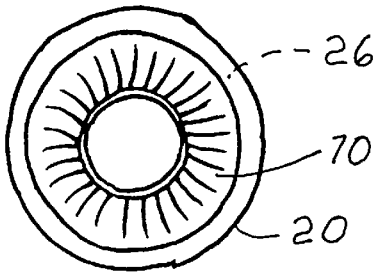
Figure 12A:
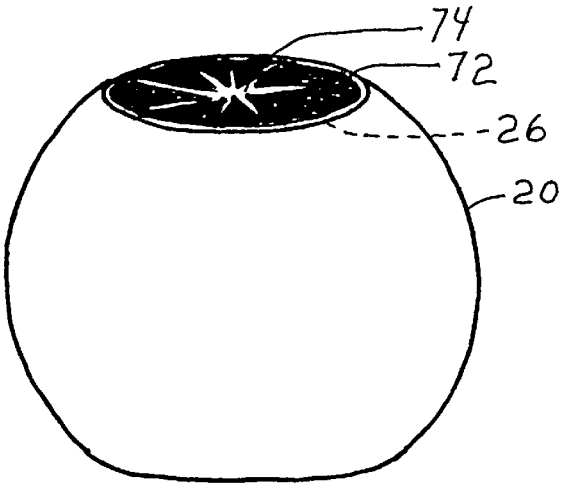
FIGS. 12*a* and 12*b* illustrate a bead with an alternative retaining device in the hole.
Figure 12B:
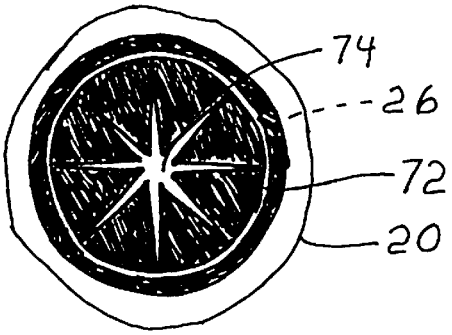

As alternatives to pinning in place the retainers 20 may be manufactured with a variety of specialized rings surrounding and covering the openings 26 in the retainers. FIGS 11*a* and 11*b* illustrate an elastic ring 70 that allows for various types of drapery material and thicknesses of the fabric to be accommodated without vertical slippage of the retainer 20. As a further variation in FIGS. 12*a* and 12*b* a flexible rubber or plastic ring 72 is formed with a starburst opening 74 to provide accommodation for a wide variety of drapery fabrics and thicknesses.

Figure 13A:
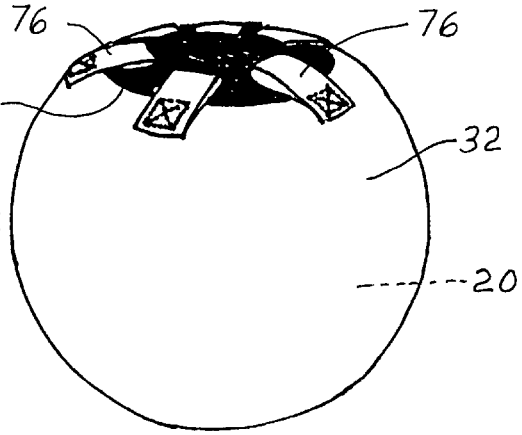
FIGS. 13*a* and 13*b* illustrate a bead with a retention device fastened about the periphery of the hole.
Figure 13B:
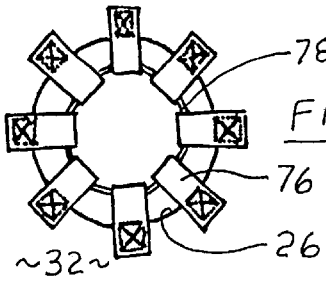
Figure 14:
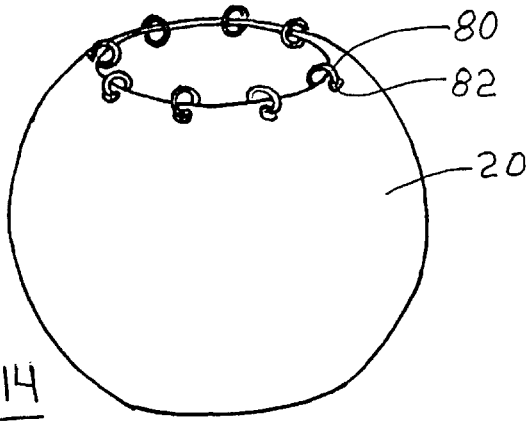
FIGS. 14*a* and 14*b* illustrate a second retention device fastened about the periphery of the hole.
Figure 14B:
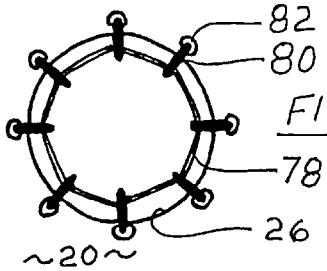

FIGS. 13*a* and 13*b* illustrate a more decorative construction with nylon loops 76 sewn to the fabric cover 32 about the opening 26. The nylon loops hold an elastic cord or drawstring 78 to form an elastic opening to engage the drape. In FIGS. 14*a* and 14*b* elastic rings 80 pass through holes 82 about the opening 26 in the retainer 20. An elastic cord or drawstring 78 passes through the elastic rings 80 to form the elastic opening that engages the drape.

Figure 15A:
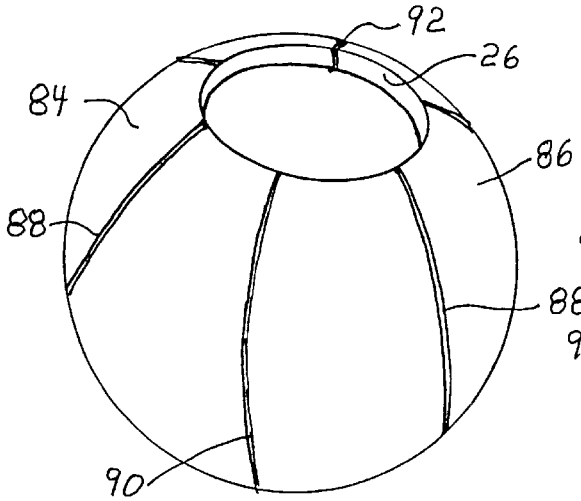
FIGS. 15*a* and 15*b* illustrate a split bead and attachment.
Figure 15B:
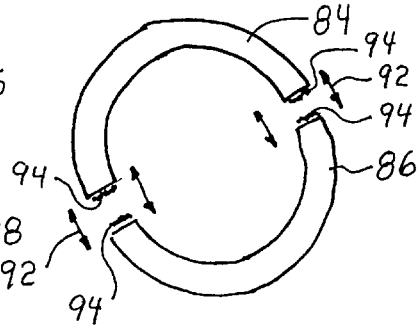

The above described retainers all require the drapery material be passed into and through the retainer, however, in some instances it may be more desirable to open and close the retainer about the gathered drape. FIGS. 15*a* and 15*b* illustrate a retainer split into two halves 84 and 86. The split retainer is decorated with several faux seams 88 to disguise two actual seams 90 and 92 on opposite sides of the retainer. The actual seams have either complementary hook and loop fasteners or magnetic strips 94 to hold the retainer halves 84 and 86 together upon application to the gathered drape.

Figure 16A:
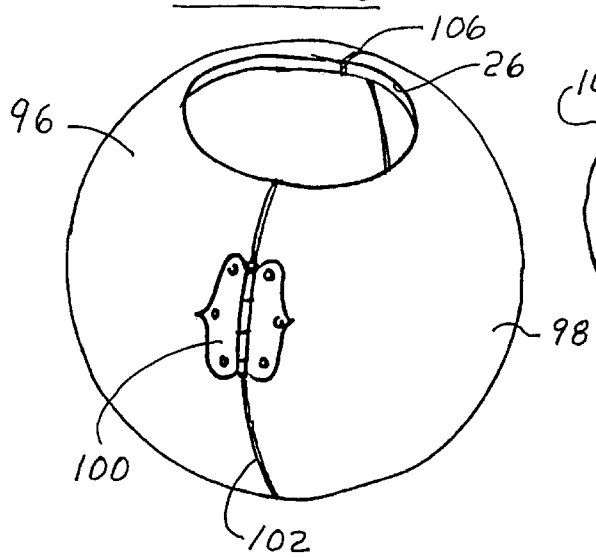
FIGS. 16*a* and 16*b* illustrate a split bead and hinged attachment.
Figure 16B:
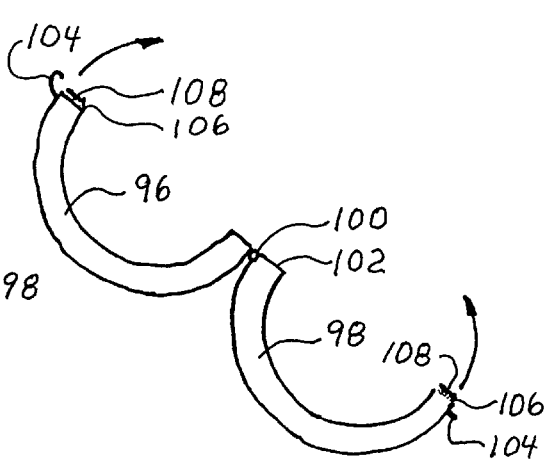

As an alternative FIGS. 16*a* and 16*b* show a hinged retainer having two halves 96 and 98 joined by a hinge 100 at one seam 102 and a clasp 104 at the other seam 106. Hook and loop or magnetic strips 108 may be used on the other seam 106 or the hinge 100 may include a spring that urges the halves 96 and 98 closed.

Figure 17:
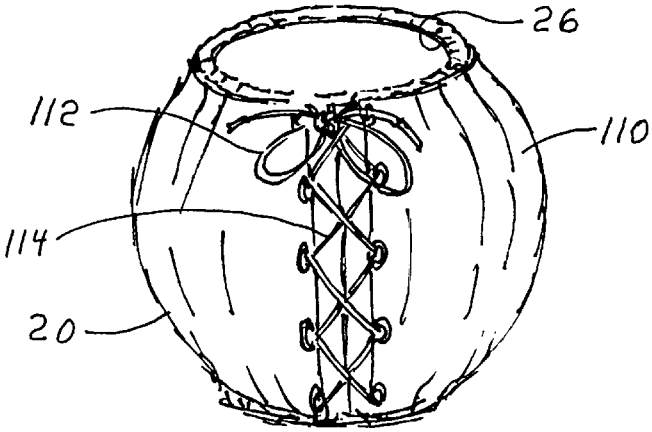
FIG. 17 illustrates a separate decorative cover attached with a drawstring and laces.

Illustrative of the wide variety of decorations that may be applied to the retainer 20 is the fabric bag 110 with a drawstring 112 and lacing 114 shown in FIG. 17. Such a cover may be easily removed for cleaning or replacement.

Figure 18:
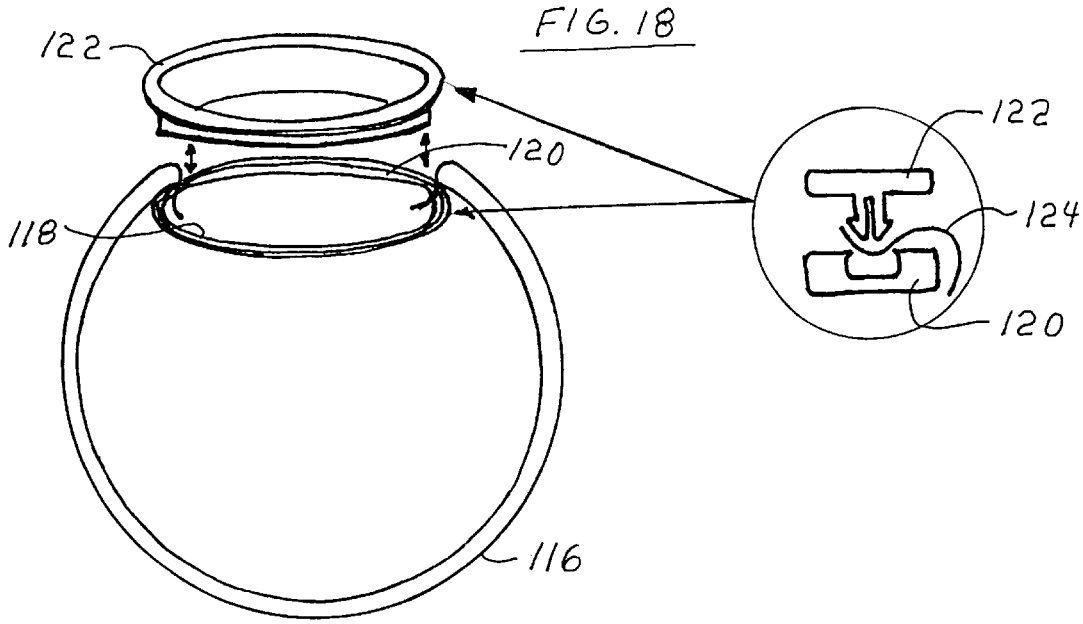
FIG. 18 illustrates a terminating bead with a snap ring to retain a separate decorative cover.

FIG. 18 illustrates a special purpose retainer 116 having only one opening 118 for insertion of a drape. A top track 120 is formed or molded into the periphery of the opening 118. A complementary ring 122 is shaped as shown to snap into the track 120 and retain fabric 124 wrapped over the retainer 116. Depending on the hardness of the retainer 116 material the pin 62 means shown in FIG. 9 or 10 may be used to hold the retainer to the end of the drape after the end is gathered and inserted into the retainer through opening 118. An application of the retainer 116 is illustrated in FIG. 19.

Figure 19:
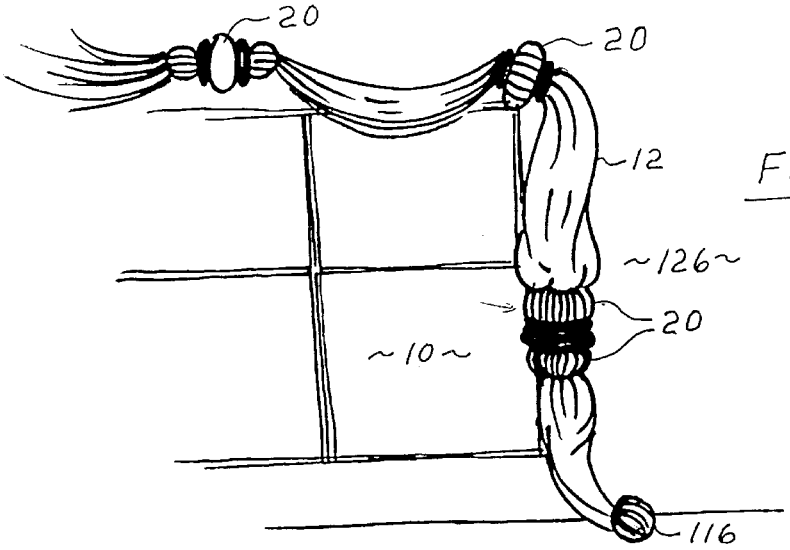
FIG. 19 illustrates a partial window and drape with a terminating bead at the end of the drape.
Figure 20:
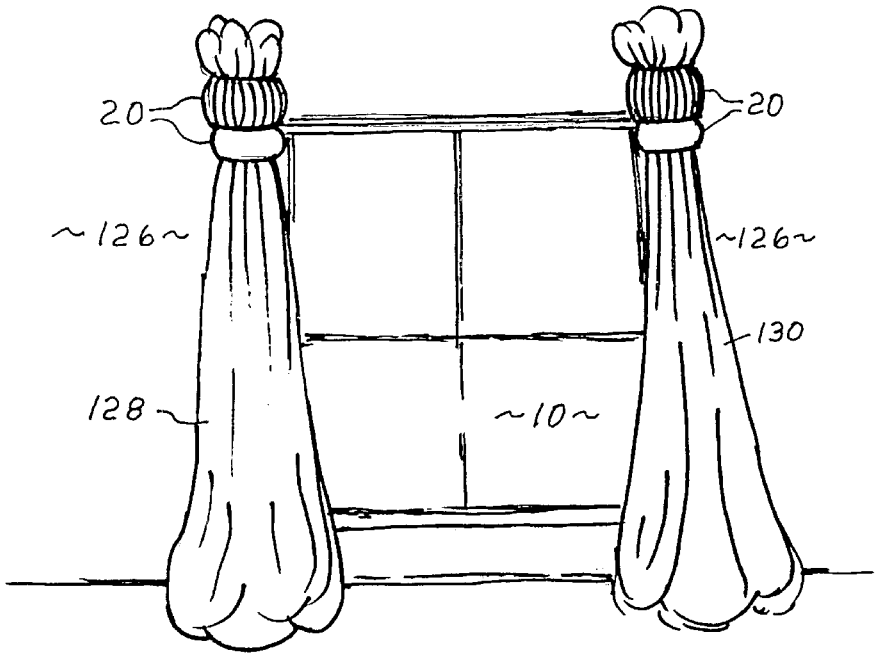
FIG. 20 illustrates a window with tower drapes to either side.

In FIG. 19, retainers 20 are shown used decoratively to create a fullness and curvy appearance to a drapery panel 12 about one side of a window 10. Retainers 20 are stacked in groups as shown, however, only the largest diameter retainer in each stack is attached to the wall 126 therebehind as further explained below. In FIG. 20 a different decorative appearance is created by having one or more retainers 20 supporting separate drapes 128 and 130 to either side of a window 10. Hereagain the drapes 128 and 130 are supported by retainers 20 attached from behind to the wall 126.

Figure 21A:
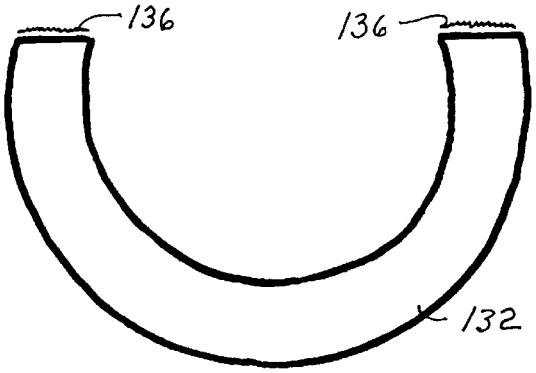
FIGS. 21*a,* 21*b* and 21*c* illustrate the use of a half bead wall attachment to obtain the decorative effects shown in FIGS. 19 and 20.
Figure 21B:
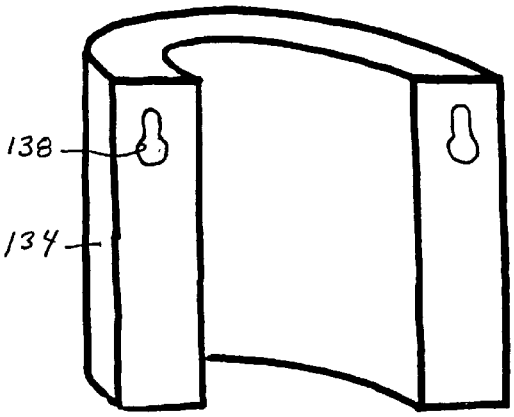
Figure 21C:
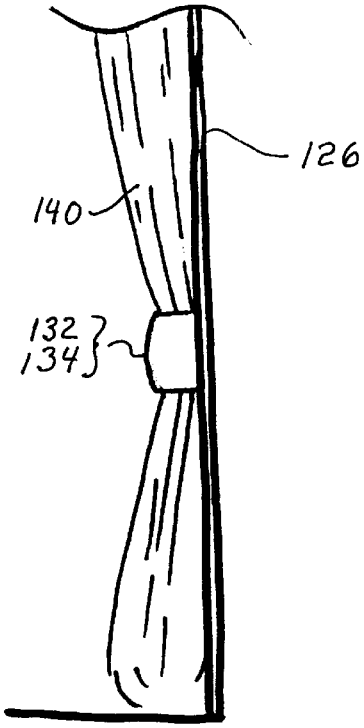

A wide variety of means may be employed to attach a retainer 20 to a wall 126 to obtain the effects shown in FIGS. 19 and 20. The retainers may be formed as half retainers 132 or 134 as illustrated in FIGS. 21*a* and 21*b*. The half retainers may use hook and loop fasteners wherein one part 136 is attached to the retainer 132 and the complementary part (not shown) is attached to the wall. Or, as shown in FIG. 21*b,* keyhole slots 138 maybe formed in the half retainer 134 to engage screws in the wall (not shown). In either application the drape 140 is retained to the wall 126 by the half retainer 132 or 134 as shown in FIG. 21*c*.

Figure 22A:
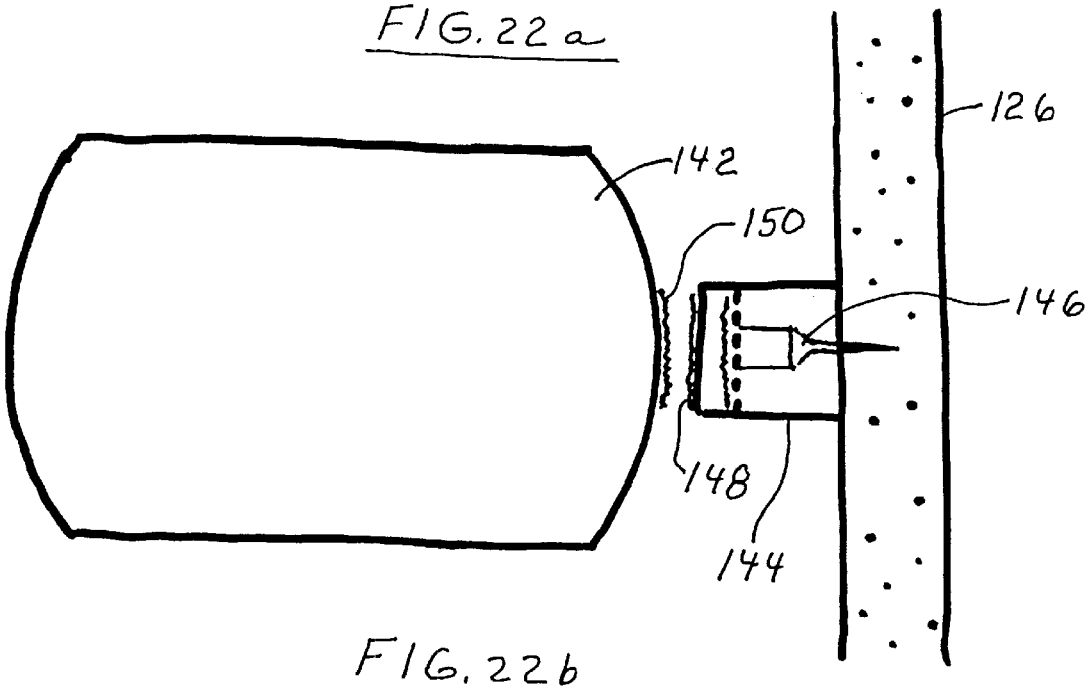
FIGS. 22*a* and 22*b* illustrate an assembly for retaining a full bead to a wall in a valence application.
Figure 22B:
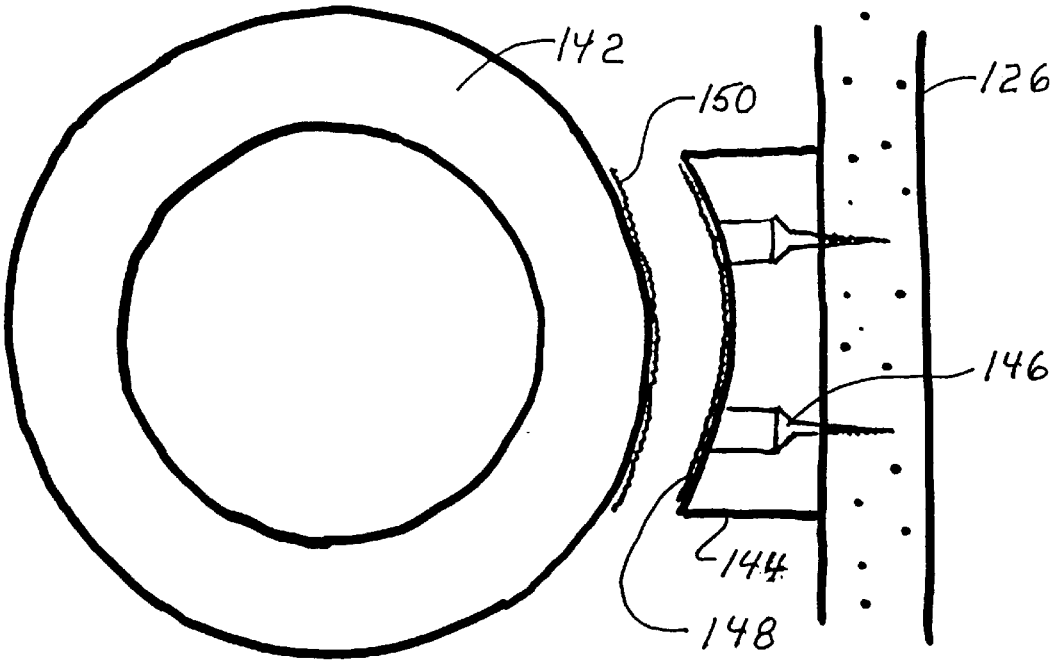
Figure 23:
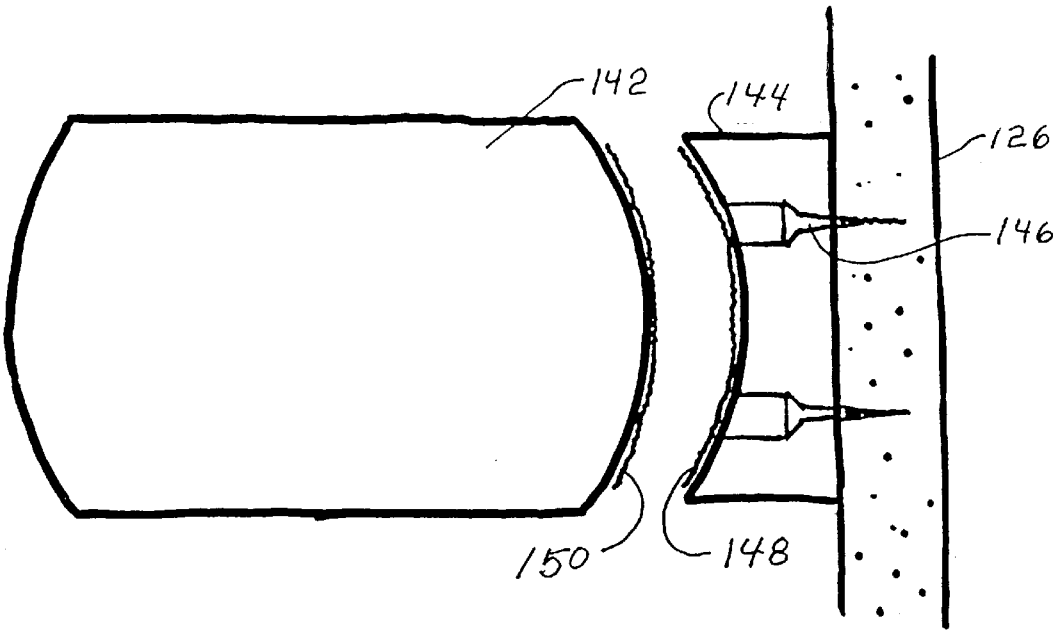
FIG. 23 illustrates the assembly of FIG. 22 modified for a vertical drape application.
Figure 24:
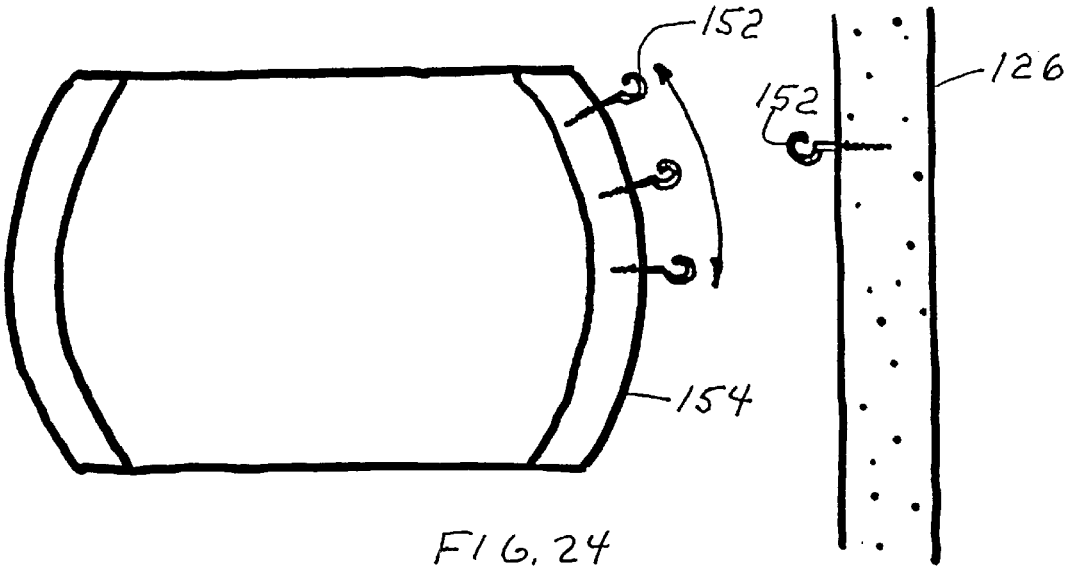
FIG. 24 illustrates an alternative assembly for retaining a full bead to a wall in a vertical drape application.

FIGS. 22*a* and 22*b* illustrate retainers 142 attachable to a wall 126 in a valence application. In this embodiment a bracket 144 is screwed 146 to the wall 126 and complementary hook and loop fasteners 148 and 150 attach the retainer 142 to the bracket 144. In the vertical drape application shown in FIG. 23 the complementary portion 150 of the hook and loop fastener is positioned on the retainer 142 perpendicular to the position in FIGS. 22*a* and 22*b*. Although illustrated in terms of hook and loop fasteners 148 and 150 any other suitable fasteners might be employed such as the cup hooks 152 illustrated in FIG. 24. Multiple cup hooks 152 may be employed as shown to adjust the orientation of the retainer 154 to which the cup hooks are attached.

Figure 25A:
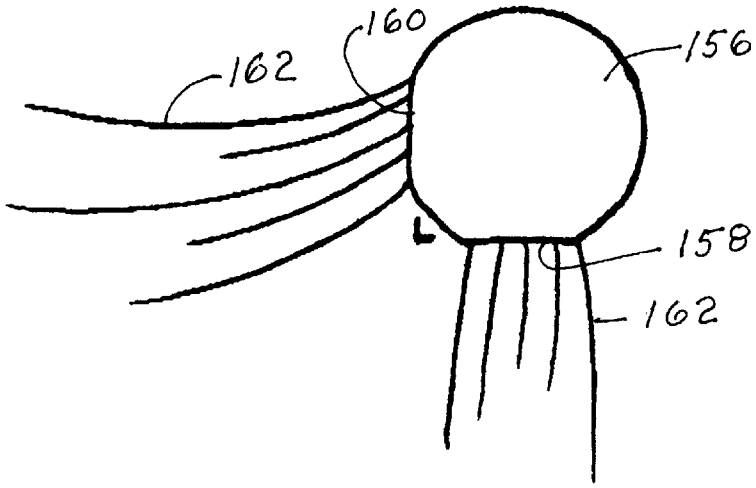
FIGS. 25*a* and 25*b* illustrate a bead with perpendicular holes.
Figure 25B:
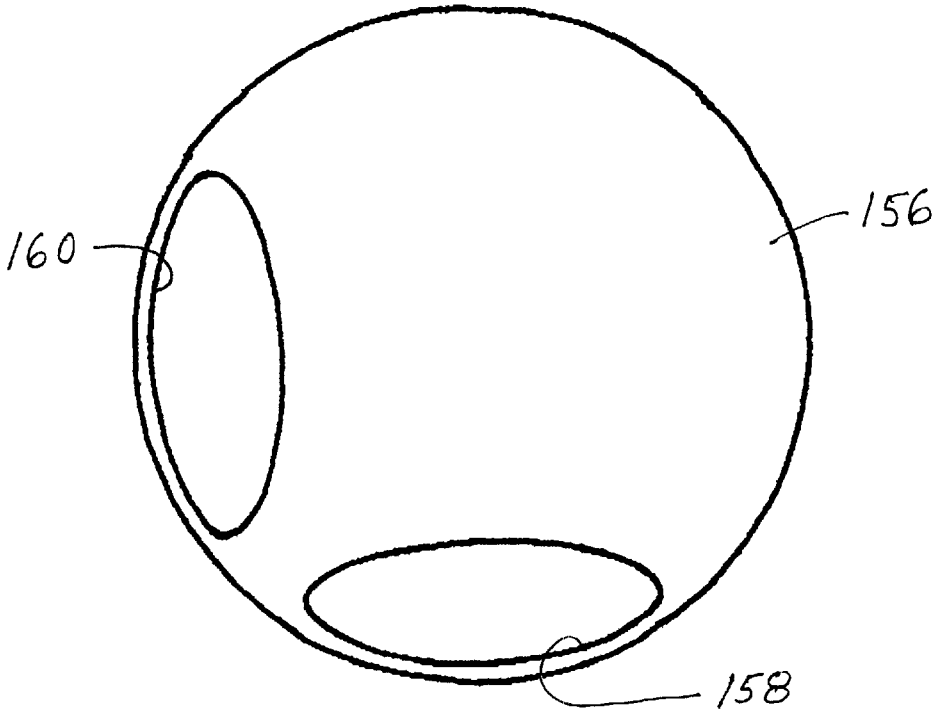

In FIGS. 25*a* and 25*b* the retainer 156 comprises a hollow spherical shape having holes 158 and 160 substantially perpendicular to each other. The version of FIG. 25 permits a drape 162 to pass through retainer 156 and is particularly suited to a corner where a horizontal drape becomes a vertical drape as shown in FIG. 25*a*.

Figure 26A:
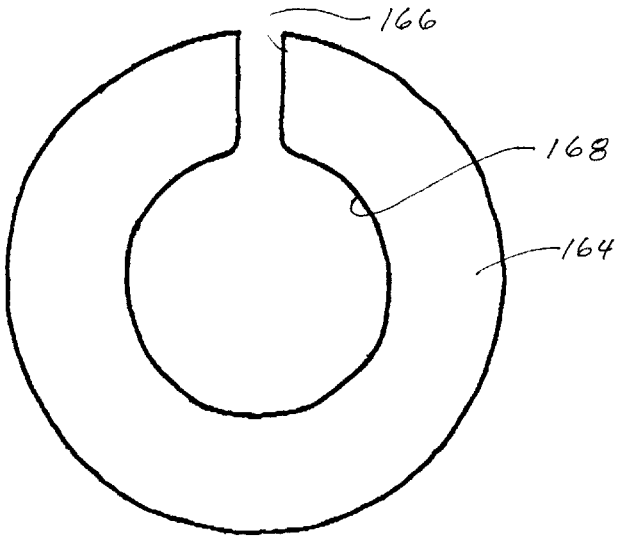
FIGS. 26*a,* 26*b* and 26*c* illustrate a bead with a slotted back intersecting the through hole.
Figure 26C:
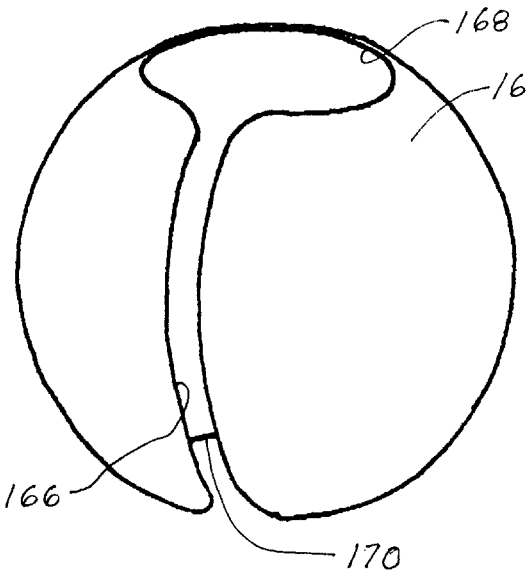
Figure 26B:
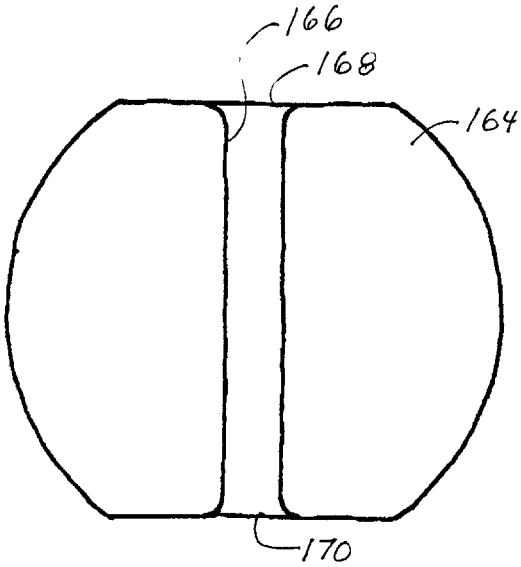

FIGS. 26*a* and 26*b* illustrate in top and side views respectively a retainer 164 having a slot 166 extending between and communicating with hole 168 and hole 170 in the top and bottom of the retainer. The retainer 164 as best shown in FIG. 26*c* is a thin shell and with the slot 166 allows the retainer to be easily placed on a drape without requiring the end of the drape be threaded through the retainer.

Figure 27A:
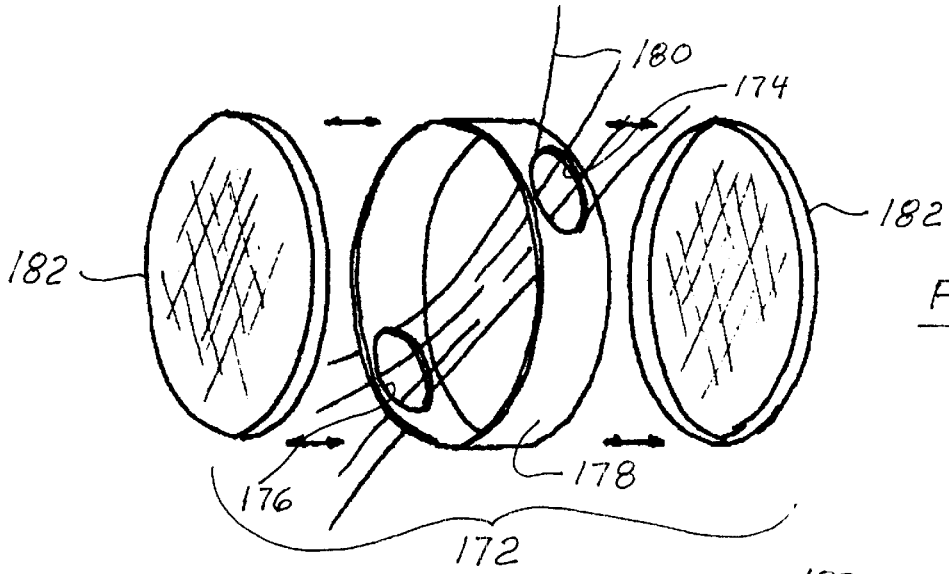
FIGS. 27*a* and 27*b* illustrate a flat bead with the through hole piercing the curved sidewall.
Figure 27B:
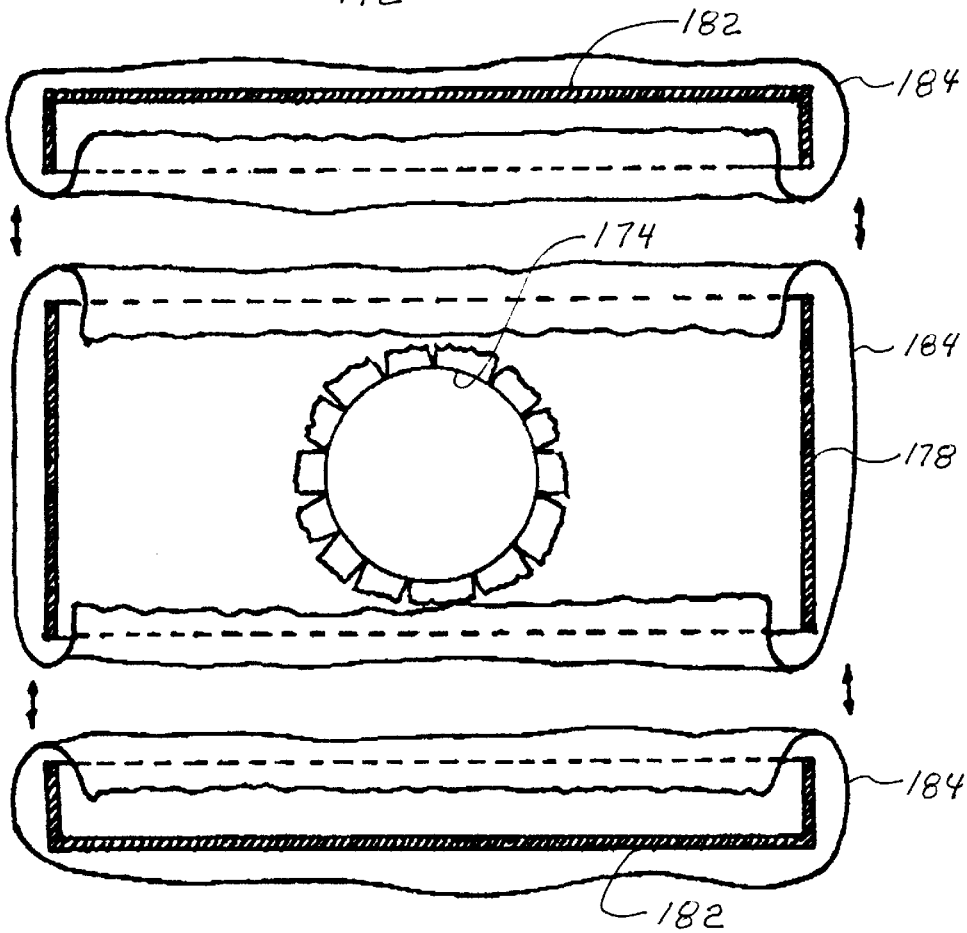

The retainer 172 of FIGS. 27*a* and 27*b* comprises a disc of sufficient interior volume to accommodate a pair of holes 174 and 176 in the curved sidewall 178 for a drape 180 to pass therethrough. The flat ends 182 are in the form of "lids" that may fit onto the sidewall 178 in the manner of metal lids on a can. Or, in the alternative, as best shown in FIG. 27*b* fabric 184 may be wrapped on the sidewall 178 and lids 182 and then the lids adhesively attached to the sidewall.

What is claimed is:

1. A drapery retainer comprising a very large spherical bead having a sidewall and hollow interior, no more than two holes formed in the bead by truncating a portion of the bead sidewall and communicating with the hollow interior, said holes and bead hollow interior sized to accept a drape inserted through the holes and into the hollow interior, and a decorative covering applied to the retainer and means to attach the covering to the retainer.

2. The drapery retainer of claim 1 wherein the second drapery hole in the bead formed by truncating a portion of the bead sidewall is diametrically opposite to the other hole.

3. The drapery retainer of claim 2 including means to selectably open the sidewall of the retainer for insertion of a drape therethrough.

4. The drapery retainer of claim 1 including one hole in the sidewall substantially perpendicular to the other hole.

5. The drapery retainer of claim 1 including drape engagement means attached to the retainer about one hole, said drape engagement means adapted to increase resistance to movement of the retainer on the drape.

6. A drapery retainer comprising a very large spherical bead having a sidewall and hollow interior, no more than two holes formed in the bead by truncating a portion of the bead sidewall and communicating with the hollow interior, said holes and bead hollow interior sized to accept a drape inserted through the holes and into the hollow interior, and attachment means fitable into one hole and adapted to fit into a hole of a second drapery retainer.

7. A drapery retainer comprising a very large spherical bead having a sidewall and hollow interior, no more than two holes formed in the bead by truncating a portion of the bead sidewall and communicating with the hollow interior, said holes and bead hollow interior sized to accept a drape inserted through the holes and into the hollow interior, and wall attachment means on the retainer sidewall and separate means attachable to a wall, said wall attachment means selectably attachable to the separate wall attachment means.

8. A drapery retainer comprising a very large spherical bead having a sidewall and hollow interior, no more than two holes formed in the bead by truncating a portion of the bead sidewall and communicating with the hollow interior, said holes and bead hollow interior sized to accept a drape inserted through the holes and into the hollow interior, wherein the second hole in the bead formed by truncating a portion of the bead sidewall is diametrically opposite to the other hole, and a slot in the sidewall communicating between the two holes.

9. A drapery retainer comprising a very large spherical bead having a sidewall and hollow interior, no more than two holes formed in the bead by truncating a portion of the bead sidewall and communicating with the hollow interior, said holes and bead hollow interior sized to accept a drape inserted through the holes and into the hollow interior, and wherein one hole is the sole hole sized for insertion of a drape.

10. A decorative interior wall treatment for trimming a window or doorway, said wall treatment comprising at least one drape and at least one very large spherical bead, said bead formed with a sidewall and a hollow interior and no more than two drapery holes formed by truncating a portion of the bead sidewall and communicating with the hollow interior, said drape being gathered and inserted through the holes and into the hollow interior.

* * * * *